US012782076B2

(12) United States Patent
Cole

(10) Patent No.: US 12,782,076 B2
(45) Date of Patent: Nov. 3, 2026

(54) MUZZLE ATTACHMENT WITH LOCKING MECHANISM

(71) Applicant: Sig Sauer, Inc., Newington, NH (US)

(72) Inventor: Jesse D. Cole, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 72 days.

(21) Appl. No.: 18/664,728

(22) Filed: May 15, 2024

(65) Prior Publication Data

US 2026/0022907 A1 Jan. 22, 2026

Related U.S. Application Data

(60) Provisional application No. 63/502,428, filed on May 16, 2023.

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/38; F41A 21/34; F41A 21/32; F41A 21/325; F41A 21/30
USPC ..... 89/14.2–14.5; 181/223
See application file for complete search history.

(56) References Cited

U.S. PATENT DOCUMENTS 5,357,842 A * 10/1994 Reynolds ..... F41A 21/36 89/14.3
10,337,820 B2 * 7/2019 Jager ..... F41A 21/36
11,480,414 B2 * 10/2022 Salinas ..... F41A 21/36

* cited by examiner

*Primary Examiner* — Reginald S Tillman, Jr.
(74) *Attorney, Agent, or Firm* — Secant IP, PLLC

(57) ABSTRACT

A muzzle attachment for a firearm includes an attachment body defining a projectile passage therethrough along a longitudinal axis, the projectile passage having a proximal end portion sized to receive a distal end portion of a barrel of the firearm or an adapter attached to the barrel. A locking assembly is provided in the attachment body and is operable to tighten the body to the barrel or muzzle adapter by engaging the barrel or muzzle adapter. In one example, the locking assembly includes a fastener that when advanced moves a yoke into engagement with a circumferential groove on the barrel or muzzle adapter. The attachment can be, for example, a compensator, flash hider, or muzzle brake.

20 Claims, 7 Drawing Sheets

MUZZLE ATTACHMENT WITH LOCKING MECHANISM

RELATED APPLICATIONS

This application claims the benefit under 35 U.S.C. § 119(e) of U.S. Provisional Patent Application No. 63/502,428 filed on May 16, 2023 and titled MUZZLE ATTACHMENT WITH LOCKING MECHANISM, the contents of which are incorporated herein by reference in its entirety.

FIELD OF THE DISCLOSURE

The present disclosure relates generally to firearm muzzle attachments and more specifically to a muzzle attachment with a locking mechanism.

BACKGROUND

A muzzle brake or recoil compensator is a type of muzzle device for a firearm that is designed to reduce muzzle rise or "muzzle flip" by redirecting a portion of propellant gases leaving the barrel. For example, a compensator functions by directing some of the propellant gases upward to counter recoil forces that tend to cause muzzle rise upon firing the gun. Some compensators can be attached to the barrel by threading the device directly onto a threaded barrel. Other compensators are formed integrally as part of the barrel, such as when the barrel defines ports to vent gases upward upon firing. A recoil compensator or simply "compensator" may be used on a handgun or long gun with the advantage of assisting the shooter to more quickly realign sights on a target for the next shot.

The figures depict various embodiments of the present disclosure for purposes of illustration only. Numerous variations, configurations, and other embodiments will be apparent from the following detailed discussion.

DETAILED DESCRIPTION

Disclosed is a firearm muzzle attachment assembly that includes a locking mechanism. In one example embodiment, the muzzle attachment is configured as a compensator for a semiautomatic handgun. The attachment body defines a projectile opening that extends through the attachment body along a longitudinal axis and is sized for passage of a projectile fired from the firearm. A proximal end portion of the attachment body defines a proximal opening sized to receive a firearm barrel or a muzzle adapter attached to the end of the barrel, where the proximal opening is arranged coaxially with the bore of the barrel.

A locking assembly in the proximal end portion of the attachment body is operable to secure the body to a barrel or muzzle adapter received in the proximal opening. In one example, the locking assembly includes a fastener that when advanced moves a yoke into engagement with a circumferential groove on the barrel or muzzle adapter. In the installed condition, the locking assembly can be tightened to fix the rotational and axial position of the attachment.

Overview

Existing handgun compensators can be attached to the end of the barrel by threaded engagement. The threads must be formed so that the compensator is properly timed with the handgun when tightened. When a compensator is installed, however, the act of tightening the compensator can wear the threads and effectively add a small amount of length to the threads each time the compensator is installed. Over the course of several installations, the compensator may no longer be timed properly when tightened on the barrel. For example, the compensator rotates beyond its properly aligned position before the threads tighten. Also, thermal cycling during use can loosen the threaded engagement, causing the compensator to loosen and potentially fall off. The present disclosure addresses these and other challenges by providing a compensator attachment with a locking mechanism.

Example Structures and Methodologies

Figure 1:
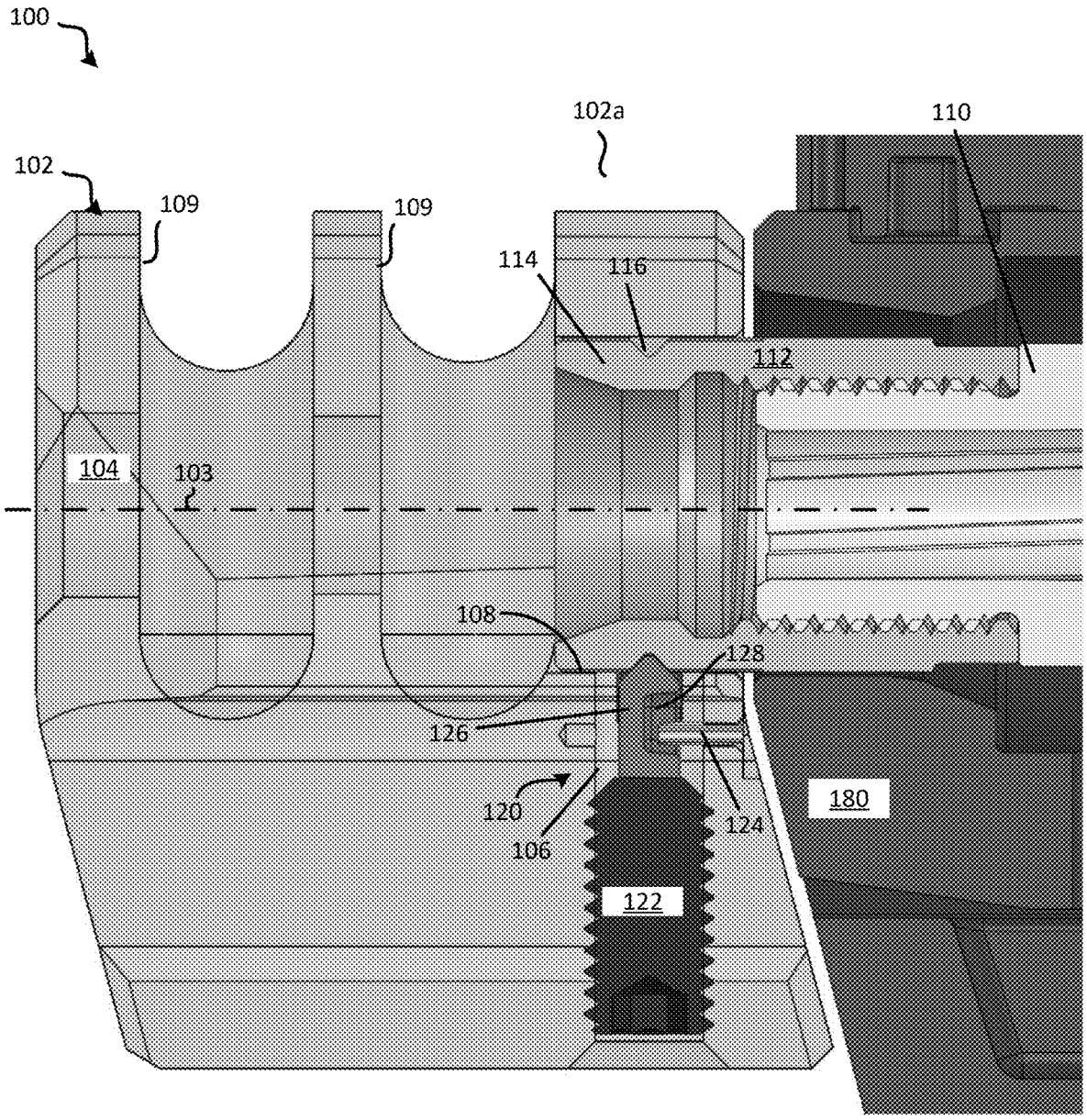
FIG. 1 illustrates a side and cross-sectional view of a muzzle attachment secured to an adapter on a firearm barrel, in accordance with an embodiment of the present disclosure.

FIG. 1 illustrates a side and cross-sectional view of a muzzle attachment assembly 100 in an installed condition, in accordance with an embodiment of the present disclosure. The muzzle attachment assembly 100 includes a muzzle attachment 102 configured to be attached to a firearm barrel 110 or adapter 112 secured to the firearm barrel 110. The attachment 102 includes a locking mechanism 120 that is configured to fix the rotational and axial position of the attachment 102 in the installed condition.

In this example, the attachment 102 is a compensator, in particular a compensator configured for use with a semiautomatic handgun. The attachment 102 attaches to an adapter 112 that is threaded onto the threaded end portion of the barrel 110. In other embodiments, the muzzle attachment 102 can be configured for direct attachment to the barrel 110, such as a barrel of a rifle or handgun. While the attachment assembly 100 is discussed in the context of a compensator for a semiautomatic handgun, the locking assembly 120 and principles of the present disclosure can be applied to other attachments 102, including a flash hider, a muzzle brake, a barrel weight, or other muzzle attachment.

Attachment 102 defines a projectile passage or projectile opening 104 extending therethrough along a central axis 103, where the projectile opening 104 is sized for passage of a projectile fired from the firearm. For example, for some firearms chambered for 0.30" to 0.45" caliber projectiles, the barrel has an outer diameter from 0.5" to 0.625". A proximal end portion 102*a* of the attachment 102 defines a proximal opening 108 or sized to receive the barrel adapter 112 or barrel 110, where the proximal opening 108 is larger in size and is coaxially arranged with the projectile opening 104. For example, the proximal opening 108 is sized for a slip fit over the barrel adapter 112 or muzzle end of a barrel 110 as the case may be. In this example, the attachment 102 defines one or more ports 109 arranged to direct a portion of combustion gases away from the central axis 103. Whether configured as a compensator (as shown in FIG. 1), a flash hider, or a muzzle brake, for example, the port(s) 109 direct combustion gases away from the projectile opening 104 by providing an alternate flow path to the environment. Here, ports 109 open through the top surface of the attachment 102 to direct combustion gases upward. As a result, the attachment can function as a compensator to counteract recoil forces that tend to result in muzzle rise.

In this example, the attachment 102 is configured to be installed on an adapter 112 that is threaded onto the firearm's barrel 110. In some embodiments, the adapter 112 threadably attaches to a threaded barrel 110; in other embodiments, the adapter 112 is fixed using other means, such as welding or a set screw. As shown in FIG. 1, a distal end portion 114 of the adapter 112 extends beyond the distal end 180*a* of the handgun's slide 180. The outside of the distal end portion 114 defines a circumferential groove 116. In some embodiments, the circumferential groove 116 generally has a V-shaped profile, which can define a vertex at a single point or can have a flat at its deepest point. The V-shape of the circumferential groove 116 enables a wedge engagement with the adapter interface 126 (e.g., a yoke) of the locking mechanism 120, which has a corresponding profile. Other profiles of the circumferential groove 116 are acceptable, including a semicircular, a rectangular, or a trapezoidal profile.

The locking mechanism 120 includes a fastener 122 that extends perpendicularly to the central axis 103 of the attachment 102. In this example, the fastener 122 extends upward through a bottom surface of the attachment 102 and toward the adapter 112. For example, the fastener 122 is a set screw. In other embodiments, the fastener 122 can extend through a side or top of the attachment 102. An adapter interface 126 is between the fastener 122 and the adapter 112 and is movable in response to advancing or retracting the fastener 122. For example, advancing the fastener 122 towards the adapter 112 moves the adapter interface 126 into the circumferential groove 116 and eventually into contact with the adapter 112 when the adapter is installed on the barrel 110 or adapter 112. The adapter interface 126 can be a block, wedge, yoke, or other configuration suitable to mate with and engage the circumferential recess 116.

In some embodiments, the locking mechanism 120 includes a retaining pin 124 that extends into or through a recess or opening 128 in the adapter interface 126. In this example, the retaining pin 124 extends axially through the opening 128. The retaining pin 124 similarly could extend laterally into the opening 128 through a side of the adapter 102. Since the fastener opening 106 is open to the proximal opening 108 of the adapter in some embodiments, the retaining pin 124 is useful to maintain the adapter interface 126 in the fastener opening 106 when the attachment 102 is separated from the adapter 112. The retaining pin 124 can be a threaded fastener, roll pin, dowel pin, or the like. In other embodiments, a plate or catch can be used instead of a pin 124.

In the installed condition as illustrated in FIG. 1, for example, the attachment 102 is positioned axially on the adapter 112 so that the adapter interface 126 engages the adapter 112 at the circumferential groove 116. The adapter interface 126 has a pointed or wedge profile that corresponds to the profile of the circumferential groove 116. Owing to the V-shaped profile of the circumferential groove 116, the wedge engagement of the adapter interface 126 and the circumferential groove 116 functions as a cam to shift the adapter 102 axially as needed while the fastener 122 is advanced and so that the adapter interface 126 seats in the circumferential groove 116. In this way, the locking mechanism 120 is useful to axially position the attachment 102 on the adapter 112 or barrel 110 with the desired spacing from the end of the slide 180. The engagement between the adapter interface 126 and the adapter 112 also fixes the axial and rotational position of the attachment 102. More specifically, as shown here the mating fit between the adapter interface 126 with the tip of the yoke occupying the circumferential groove 116, in addition to the frictional forces between the adapter interface 126 with the circumferential groove 116 when the fastener 122 is tightened, prevents the attachment 102 from shifting axially and from rotating about the adapter 112. Thus, the attachment 102 can be secured to the barrel 110 with proper axial and rotational alignment.

Figure 2:
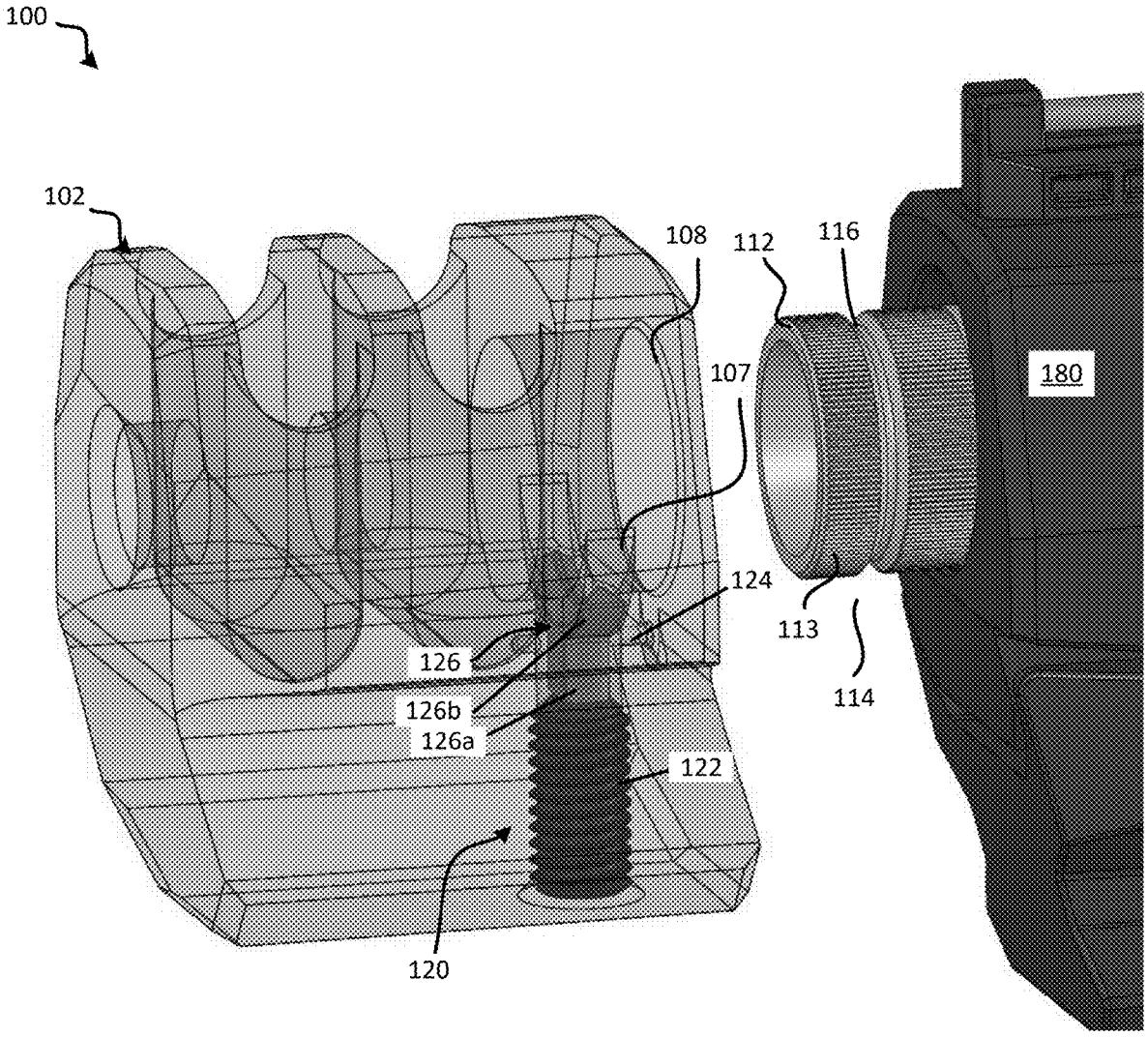
FIG. 2 illustrates a perspective view of the muzzle attachment and a distal end of a barrel adapter, where the attachment is ready for installation on the adapter, in accordance with an embodiment of the present disclosure.

Referring now to FIG. 2, a front perspective view illustrates the attachment assembly 100 of FIG. 1 where the attachment 102 is separated from the adapter 112 and is positioned for installation on the adapter 112, in accordance with an embodiment of the present disclosure. To more clearly show components of the locking mechanism 120, the attachment 102 is shown as being transparent. In this example, the adapter 112 is threadably installed on the barrel 110 (barrel not visible; shown in FIG. 1) so that the distal end portion 114 of the adapter 112 extends from the slide 180. The outer surface of the adapter 112 defines grooves or knurling 113 to enhance the frictional engagement between the adapter 112 and the attachment 102. In this example, the knurling 113 includes grooves that extend axially along the outer surface of the adapter 112. In other embodiments, the knurling 113 can be oriented at a slant, can include a crisscross or diamond pattern, or other suitable texture. As can be seen in FIG. 2, the circumferential recess 116 generally has a V-shaped profile with sloping sides 116*b* and axially extending vertex 116*a*.

Components of the locking mechanism 120 are visible through the attachment 102 and include a fastener 122 and adapter interface 126 configured as a yoke having a Y-shape. A retaining pin 124 extends in an axial direction through a proximal face of the attachment 102 and into or through the adapter interface 126. As such, the retaining pin 124 prevents loss of the adapter interface 126 when the attachment 102 is removed from the adapter 112. The adapter interface 126 is configured as a yoke generally having a Y-shape that includes a post portion 126*a* that extends radially to abut the end of the fastener 122. The adapter interface 126 also includes an arcuate portion 126*b* that is transverse to the post portion 126*a*. The arcuate portion 126*b* has a profile corresponding to that of the circumferential groove 116. In this example, the fastener 122 has been retracted downward so that the adapter interface 126 occupies a slot or recess 107 along the inside of the proximal opening 108. In this position, the adapter interface 126 is recessed into the attachment 102, providing sufficient clearance with the adapter 112 to enable installation onto or removal from the adapter 112.

Figure 3:
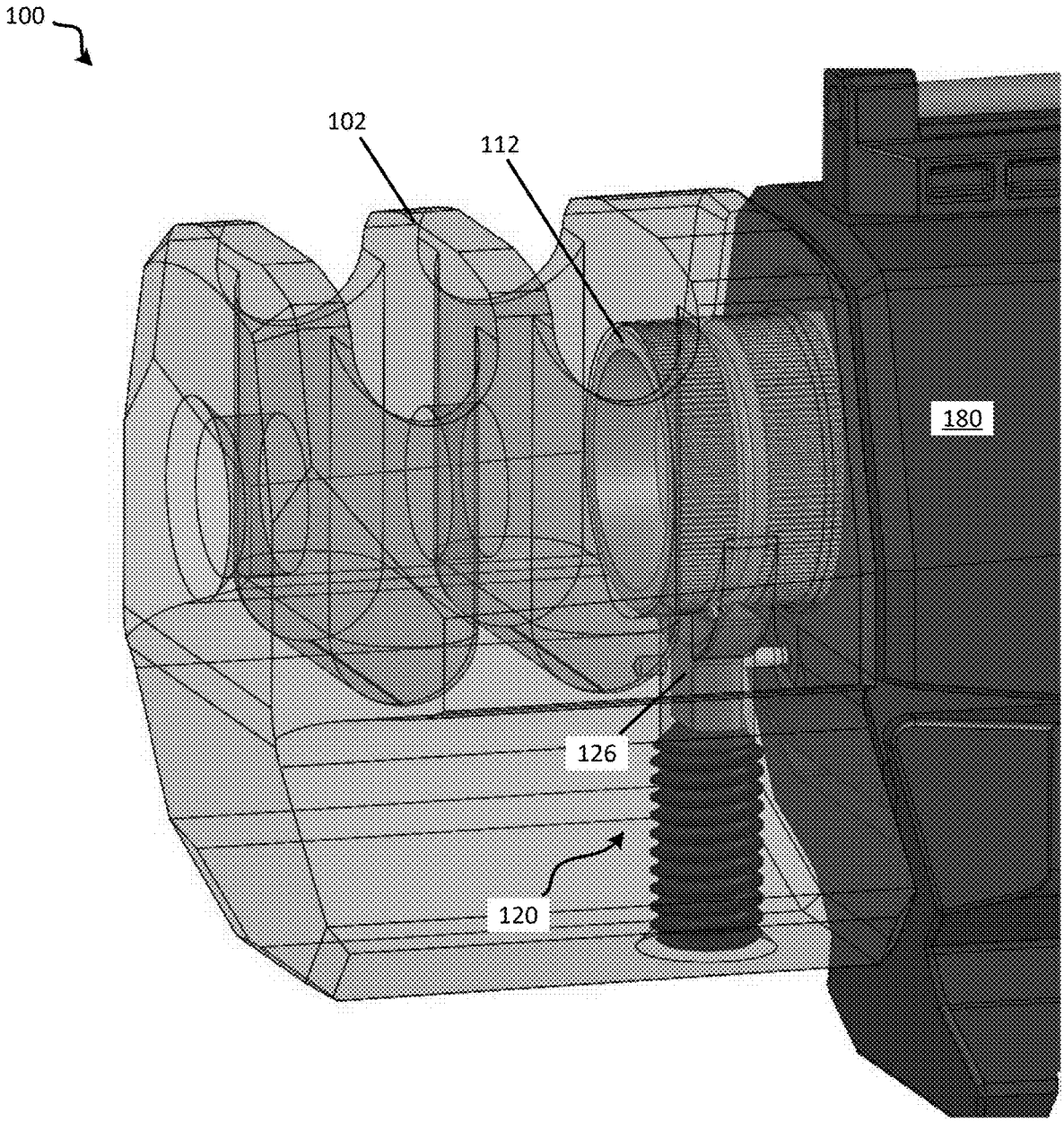
FIG. 3 illustrates a perspective view of a muzzle attachment installed on a muzzle adapter with a locking mechanism in an unlocked position, in accordance with an embodiment of the present disclosure.

FIG. 3 illustrates a front perspective view showing the attachment assembly 100 of FIG. 2 after installing the attachment 102 on the adapter 112. The attachment 102 has been aligned rotationally with the firearm slide 180. In some embodiments, the attachment 102 is constructed with features that correspond to features on the slide 180 and which facilitate visual alignment of the attachment 102 to the slide 180. In this example, facets and corners on the attachment 102 can be used as a visual aid to rotationally align or time the attachment 102 with the slide 180. In this example, the locking mechanism 120 is in a loosened or unlocked state where the adapter interface 126 does not engage the adapter 112.

Figure 4:
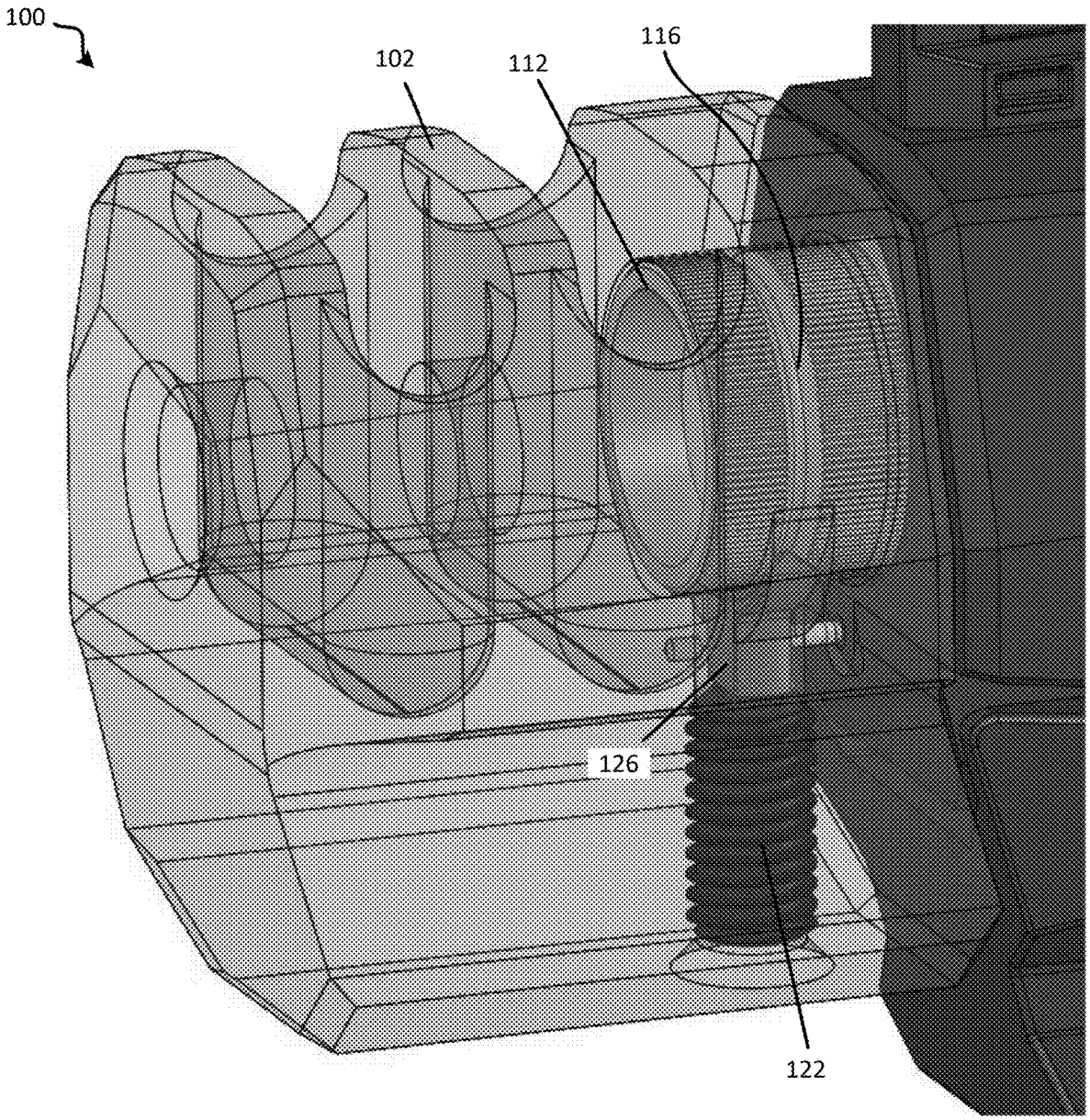
FIG. 4 illustrates a perspective view showing the muzzle attachment of FIG. 3 after advancing the fastener to draw the attachment against the muzzle adapter, in accordance with an embodiment of the present disclosure.

FIG. 4 illustrates a front perspective view showing the attachment assembly 100 of FIG. 3 with the locking mechanism 120 in a locked condition, in accordance with an embodiment of the present disclosure. In this example, the fastener 122 has been advanced upward into the attachment 102 so that the adapter interface 126 engages and seats in the circumferential groove 116 on the adapter 112, thereby tightening the adapter to the adapter 112 and frictionally engaging the circumferential groove 116. As part of tightening the fastener 122, the inside of the proximal opening 108 is drawn against the adapter 112. Due to the generally V-shaped profile of the adapter interface 126 and circumferential groove 116, the attachment 102 is cammed into axial alignment with the adapter 112 as the fastener 122 advances towards the adapter 112, if it is not already so aligned. Sufficiently tightening the fastener 122 therefore fixes the rotational and axial position of the attachment 102 on the adapter 112.

Figure 5:
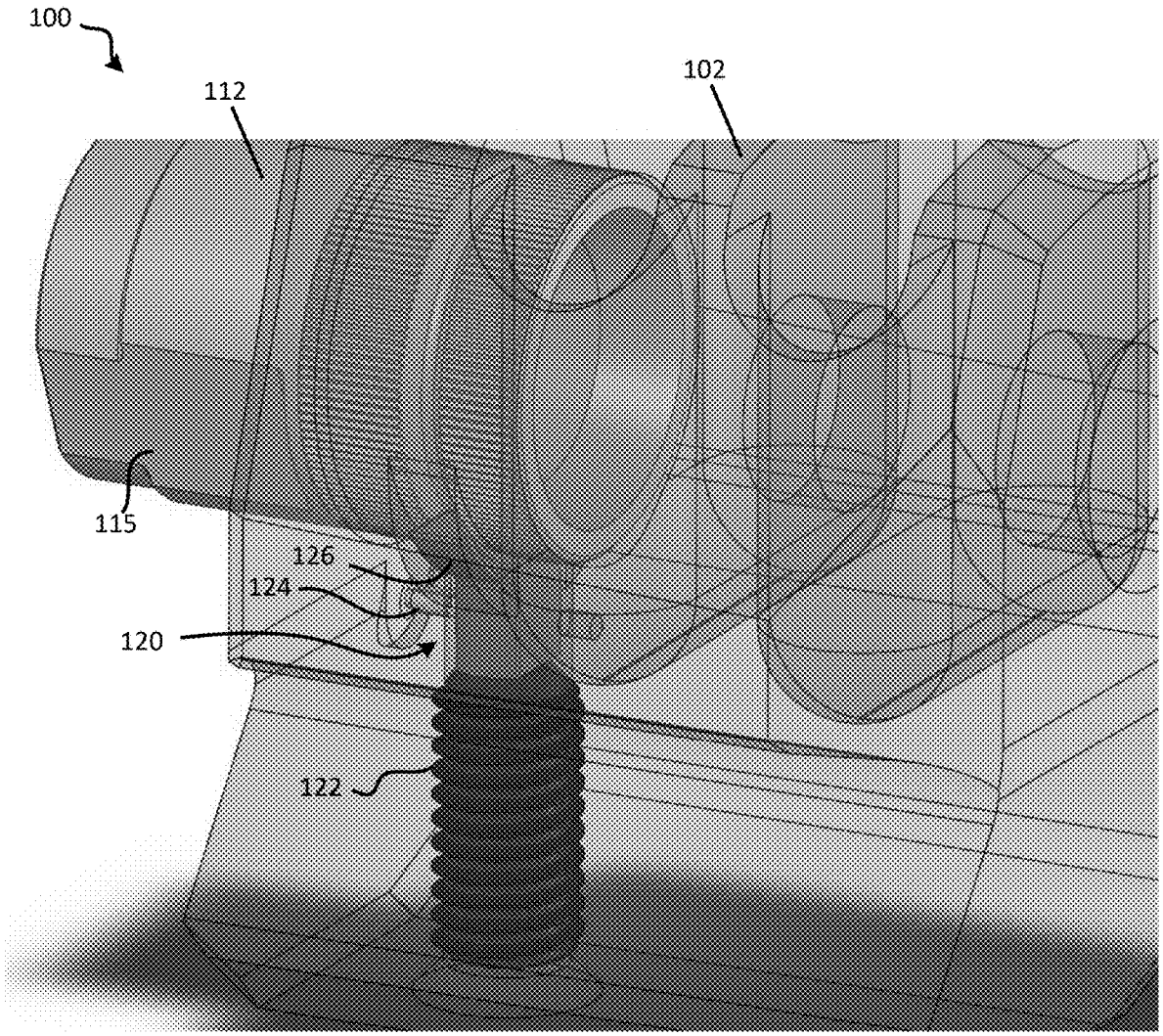
FIG. 5 illustrates a perspective view showing a muzzle attachment and muzzle adapter in an assembled state, in accordance with an embodiment of the present disclosure.

FIG. 5 illustrates a front perspective view of an attachment assembly 100 with an attachment 102 attached to an adapter 112, in accordance with an embodiment of the present disclosure. The attachment assembly 100 includes the locking mechanism 120 and can be provided in an assembled or disassembled form. For example, the attachment assembly 100 can be provided with the attachment 102, adapter 112, and components of locking mechanism 120 in a disassembled state.

In this example, the adapter 112 includes flats 115 to facilitate tightening the adapter 112 to a threaded barrel 110 (not shown in FIG. 5). For example, a spanner or wrench can be used to snug the adapter 112 to the barrel 110. Here, the attachment 102 is a compensator and is shown secured to the adapter 112 by the locking mechanism 120 in a locked condition. The locking mechanism 120 includes a fastener 122, an adapter interface 126 configured as a yoke, and a retaining pin 124.

Figure 6:
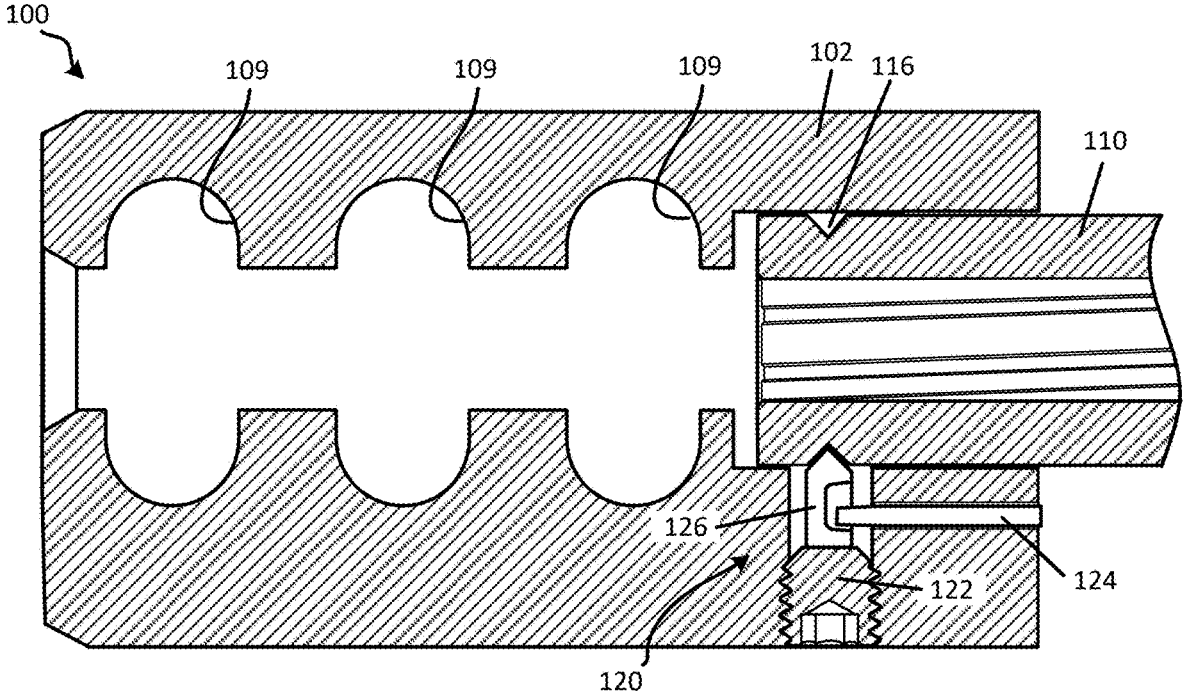
FIG. 6 is a side and cross-sectional view showing a muzzle attachment configured as a muzzle brake, where the attachment is secured directly to a firearm barrel, in accordance with an embodiment of the present disclosure.

FIG. 6 illustrates a side and cross-sectional view of an attachment 102 secured directly to the distal end of a barrel 110, in accordance with an embodiment of the present disclosure. In this example, the attachment 102 is configured as a muzzle brake with ports 109 oriented to vent combustion gases laterally. The attachment 102 includes a locking mechanism 120 that includes a fastener 122, adapter interface 126, and retaining pin 124. In the installed condition as shown here, the adapter interface 126 engages the circumferential groove 116 in the outside of the barrel 110. Similar to embodiments discussed above, the barrel 110 is received in the proximal opening 108 of the attachment 102.

Figure 7:
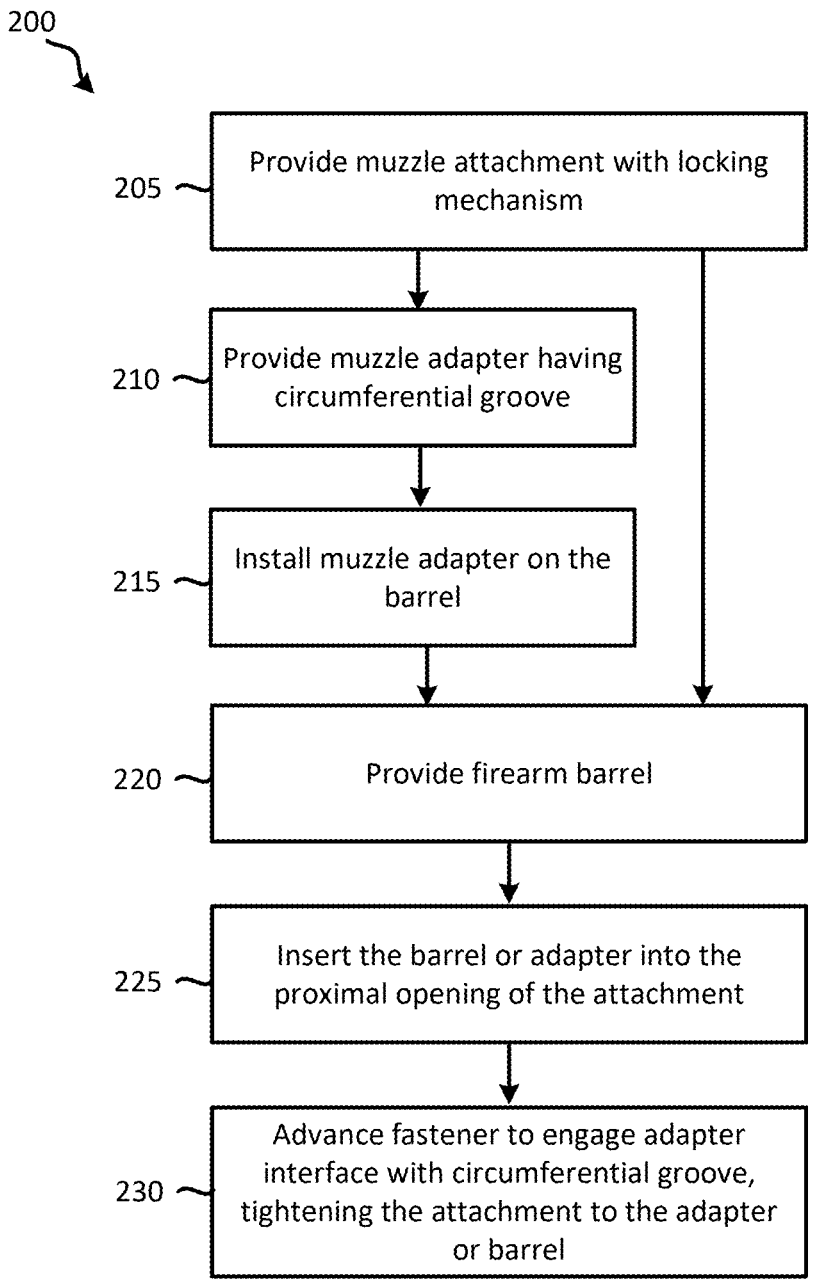
FIG. 7 is a flowchart for a method of securing a muzzle attachment to a firearm barrel, in accordance with an embodiment of the present disclosure.

FIG. 7 illustrates a flowchart for a method 200 of securing a muzzle attachment to a firearm barrel. Method 200 begins with providing 205 a muzzle attachment with a locking mechanism. Examples of suitable muzzle attachments and the associated locking mechanism are discussed above. Method also begins with providing 220 a firearm with a barrel or muzzle adapter having a circumferential groove.

In some embodiments, depending on the status of the firearm barrel, method 200 may include providing 210 a muzzle adapter having the circumferential groove and installing 215 the muzzle adapter on the barrel. For example, the barrel of the provided firearm may be a threaded barrel with a thread protector installed on the threaded end of the barrel. Providing 210 the muzzle adapter includes selecting a muzzle adapter with threads sized to mate with those on the barrel and having an outer diameter suited to be received in the proximal opening (e.g., adapter or barrel opening) in the proximal end of the attachment with a slip fit. Installing 215 the adapter includes removing the thread protector and installing an adapter having the circumferential groove. As needed, the adapter can be tightened to the barrel using a wrench or similar tool.

Method 200 continues with installing 225 the attachment on the barrel or adapter as the case may be. In some embodiments, installing the attachment involves inserting the adapter or barrel into the proximal opening of the attachment. Preferably, the adapter or barrel is sized for a slip fit within the adapter. As needed to provide clearance, the locking mechanism may be disengaged prior to installing the attachment. Installing 225 the attachment may include aligning the attachment with the firearm axially, rotationally, or both.

Method 200 continues with engaging 230 the locking mechanism with the circumferential groove on the barrel or adapter. Examples of the locking mechanism are discussed above. Engaging 230 the locking mechanism includes advancing a fastener to move an adapter interface into locking engagement with the circumferential groove and tightening the fastener to draw the attachment tightly to the adapter or barrel.

FURTHER EXAMPLE EMBODIMENTS

The following examples pertain to further embodiments, from which numerous permutations and configurations will be apparent.

Example 1 is a muzzle attachment for a firearm. The muzzle attachment has an attachment body defining a projectile passage therethrough along a longitudinal axis, where the projectile passage has a proximal end portion sized to receive a distal end portion of a barrel of the firearm. A locking assembly in the attachment body is operable to tighten the attachment body to the barrel when received in the proximal end portion of the projectile passage.

Example 2 includes the muzzle attachment of Example 1, where the locking assembly includes a threaded fastener received in a fastener opening extending to the projectile passage. A yoke has a curved portion and a base extending from the curved portion into the opening towards an end of the fastener. When the barrel is received in the proximal end portion of the projectile passage, advancing the fastener moves the yoke into the circumferential groove to tighten the attachment to the barrel.

Example 3 includes the muzzle attachment of Example 2, where the barrel defines a circumferential groove, and the curved portion of the yoke is shaped to be received in the circumferential groove.

Example 4 includes the muzzle attachment of Example 3, where the curved portion of the yoke has a profile corresponding to the circumferential groove.

Example 5 includes the muzzle attachment of Example 4, where the circumferential groove has a V-shaped profile.

Example 6 includes the muzzle attachment of any of Examples 2-5 and further comprises a retaining structure extending through part of the compensator body and into or through the yoke.

Example 7 includes the muzzle attachment of Example 6, where the retaining structure is a pin.

Example 8 includes the muzzle attachment of any of the foregoing Examples, where the attachment body defines one or more ports arranged to vent a portion of combustion gases away from the longitudinal axis upon firing the firearm.

Example 9 includes the muzzle attachment of Example 8, where the attachment is configured as a recoil compensator.

Example 10 is a compensator assembly for a firearm. In one embodiment, the assembly includes a muzzle adapter configured to threadably mount to a threaded firearm barrel. A compensator defines a projectile passage therethrough along a longitudinal axis and has a proximal end portion sized to receive the muzzle adapter. The compensator defines one or more ports arranged to direct a portion of combustion gases away from the longitudinal axis. A locking assembly in the muzzle adapter is operable to tighten the compensator body to the muzzle adapter when the muzzle adapter is received in the proximal end portion of the projectile passage.

Example 11 includes the assembly of Example 10, where the locking assembly includes a threaded fastener in a fastener opening extending to the projectile passage, and a yoke having a curved portion and a base extending from the curved portion into the fastener opening towards an end of the fastener. When the muzzle adapter is received in the proximal end portion of the projectile passage, advancing the fastener moves the yoke into the circumferential groove to tighten the attachment to the muzzle adapter.

Example 12 includes the assembly of Example 11, where an outside surface of the muzzle adapter defines a circumferential groove and where the curved portion of the yoke is configured to engage the circumferential groove.

Example 13 includes the assembly of Example 12, where the circumferential groove has a V-shaped profile.

Example 14 includes the assembly of any one of Examples 11-13, where the fastener opening is threaded and extends through a bottom of the compensator to the projectile passage.

Example 15 includes the assembly of any one of Examples 11-14, where an outside surface of the muzzle adapter includes knurling, serrations, and/or grooves.

Example 16 includes the assembly of any one of Examples 11-15, where the compensator body defines a pin opening extending through part of the compensator body to the fastener opening, and the assembly further comprises a pin configured to extend through the pin opening and into or through the yoke.

Example 17 includes the assembly of Example 16, where the base of the yoke defines a recess, and the pin occupies the recess in a locked condition.

Example 18 is a method of securing a muzzle attachment to a firearm barrel. The method includes providing a muzzle attachment defining a projectile passage therethrough along a longitudinal axis, the projectile passage having a proximal end portion sized to receive a distal end portion of a barrel of the firearm, where the muzzle attachment includes a locking mechanism with a fastener and a yoke. A firearm is provided having a barrel or muzzle adapter defining a circumferential groove. The barrel or muzzle adapter is inserted into a proximal end portion of the projectile passage. The fastener of the locking mechanism is advanced toward the projectile passage, thereby moving the yoke into engagement with the circumferential groove and tightening the muzzle attachment to the barrel or muzzle adapter.

Example 19 includes the method of Example 18, and further includes providing the muzzle adapter having the circumferential groove and installing the muzzle adapter on the barrel.

Example 20 includes the method of Example 18 or 19, where the yoke has a curved potion with a profile corresponding to a profile of the circumferential grove.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A muzzle attachment for a firearm, comprising:

an attachment body defining a projectile passage therethrough along a longitudinal axis, the projectile passage having a proximal end portion sized to receive a distal end portion of a barrel of the firearm, and further defining a fastener opening extending to the proximal end portion of the projectile passage; and a locking assembly operable to tighten the attachment body to the barrel when the barrel is received in the proximal end portion of the projectile passage, the locking assembly comprising:

a threaded fastener in the fastener opening; and a yoke having a curved portion in the proximal end portion of the projectile passage;

wherein the yoke includes a base extending from the curved portion into the fastener opening towards an end of the fastener; and wherein, when the distal end portion of the barrel is received in the proximal end portion of the projectile passage, advancing the fastener moves the yoke into contact with the barrel to tighten the attachment to a muzzle adapter.

2. The muzzle attachment of claim 1, wherein the distal end portion of the barrel defines a circumferential groove and the curved portion of the yoke is shaped to be received in the circumferential groove.

3. The muzzle attachment of claim 2, wherein the curved portion of the yoke has a profile corresponding to a profile of the circumferential groove.

4. The muzzle attachment of claim 3, wherein the profile of the circumferential groove comprises a V-shape.

5. The muzzle attachment of claim 1, further comprising a retaining structure extending through part of the attachment body and into or through the yoke.

6. The muzzle attachment of claim 5, wherein the retaining structure is a pin.

7. The muzzle attachment of claim 1, wherein the attachment body defines one or more ports arranged to vent a portion of combustion gases away from the longitudinal axis upon firing the firearm.

8. The muzzle attachment of claim 7, wherein the attachment is configured as a recoil compensator.

9. A compensator assembly for a firearm, the assembly comprising:

a muzzle adapter configured to threadably mount to a threaded firearm barrel;

a compensator defining a projectile passage therethrough along a longitudinal axis and having proximal end portion sized to receive the muzzle adapter, wherein the compensator defines one or more ports arranged to direct a portion of combustion gases away from the longitudinal axis, and wherein the compensator defines a fastener opening extending to the projectile passage; and a locking assembly in the muzzle adapter and operable to tighten the compensator body to the muzzle adapter when the muzzle adapter is received in the proximal end portion of the projectile passage, the locking assembly comprising:

a threaded fastener in the fastener opening; and a yoke having a curved portion in the proximal end portion of the projectile passage;

wherein, when the muzzle adapter is received in the proximal end portion of the projectile passage, advancing the fastener moves the curved portion of the yoke into contact with the muzzle adapter to tighten the attachment to the muzzle adapter.

10. The muzzle attachment of claim 9, wherein the yoke includes a base extending from the curved portion into the fastener opening towards an end of the fastener.

11. The assembly of claim 9, wherein an outside surface of the muzzle adapter defines a circumferential groove and wherein the curved portion of the yoke is configured to be received in the circumferential groove.

12. The assembly of claim 11, wherein the circumferential groove has a V-shaped profile.

13. The assembly of claim 9, wherein the fastener opening is threaded and extends through a bottom of the compensator to the projectile passage.

14. The assembly of claim 11, wherein an outside surface of the muzzle adapter includes knurling, serrations, and/or grooves.

15. The assembly of claim 9, wherein the compensator body defines a pin opening extending through part of the compensator body to the fastener opening, and the assembly further comprises a pin configured to extend through the pin opening and into or through the yoke.

16. The assembly of claim 15, wherein the base of the yoke defines a recess and wherein the pin occupies the recess in a locked condition.

17. A method of securing a muzzle attachment to a firearm barrel, the method comprising:

providing a muzzle attachment defining a projectile passage therethrough along a longitudinal axis, the projectile passage having a proximal end portion sized to receive a distal end portion of a barrel of the firearm, wherein the muzzle attachment includes a locking mechanism with a fastener and a yoke having a curved portion in the proximal end portion of the projectile passage;

providing a firearm with a barrel having an end portion defining a circumferential groove;

inserting the end portion of the barrel into the proximal end portion of the projectile passage; and advancing the fastener of the locking mechanism toward the projectile passage, thereby moving the curved portion of the yoke into engagement with the circumferential groove and tightening the muzzle attachment to the end portion of the barrel.

18. The method of claim 17, further comprising:

providing a muzzle adapter defining the circumferential groove; and installing the muzzle adapter on the barrel.

19. The method of claim 17, wherein the curved portion of the yoke has a profile corresponding to a profile of the circumferential grove.

20. The method of claim 17, wherein the yoke includes a base extending away from the curved portion.

* * * * *